US008186293B2

(12) United States Patent
Eriksen

(10) Patent No.: US 8,186,293 B2
(45) Date of Patent: May 29, 2012

(54) DEVICE FOR AN INERT GAS INSTALLATION ON A FLOATING VESSEL

(75) Inventor: Egil Eriksen, Foldrøyhamn (NO)

(73) Assignee: Tool-Tech AS, Rykkinn (NO)

( * ) Notice: Subject to any disclaimer, the term of this patent is extended or adjusted under 35 U.S.C. 154(b) by 234 days.

(21) Appl. No.: 12/517,337

(22) PCT Filed: Dec. 3, 2007

(86) PCT No.: PCT/NO2007/000428

§ 371 (c)(1),
(2), (4) Date: Aug. 26, 2009

(87) PCT Pub. No.: WO2008/069678

PCT Pub. Date: Jun. 12, 2008

(65) Prior Publication Data

US 2010/0078076 A1 Apr. 1, 2010

(30) Foreign Application Priority Data

Dec. 4, 2006 (NO) ..... 20065570

(51) Int. Cl.
*B63B 25/08* (2006.01)

(52) U.S. Cl. ..... 114/74 R; 114/211

(58) Field of Classification Search ..... 114/74 R, 114/74 T, 211, 212, 72

See application file for complete search history.

(56) References Cited

U.S. PATENT DOCUMENTS

| | | | | |
|---|---|---|---|---|
| 3,868,921 | A | 3/1975 | Seymour et al. | |
| 5,121,766 | A | 6/1992 | Tornay | |
| 5,285,745 | A * | 2/1994 | Husain | 114/74 R |
| 5,551,367 | A * | 9/1996 | Vitkauskas | 114/74 R |
| 7,004,095 | B2 * | 2/2006 | Bronneberg et al. | 114/74 R |

FOREIGN PATENT DOCUMENTS

| | | |
|---|---|---|
| DE | 2031905 | 1/1971 |
| JP | 04138992 A | 5/1992 |
| NO | 322719 B1 | 6/2006 |

OTHER PUBLICATIONS

International Search Report for International Patent Application No. PCT/NO2007/000428, dated Mar. 4, 2008.

* cited by examiner

*Primary Examiner* — Lars A Olson
(74) *Attorney, Agent, or Firm* — Patterson & Sheridan, LLP

(57) ABSTRACT

A device for an inert gas installation (5) on a floating vessel, comprising one or several tanks (1) arranged in a manner allowing filling of an explosive liquid (11) via suitable means (13, 14) associated therewith, and/or a gas (12), wherein an air inlet system (3) is connected to the tank (1), wherein the inert gas installation (5) is provided with a shutoff valve (51) arranged to automatically allow closing of an inert gas supply conduit (52), wherein the tank (1) is provided with a sensor (53) arranged to respond to a defined, ambient moisture and pressure level, the sensor (53) also being connected to a valve control system (7), thereby providing control signals to the valve control system (7). The invention also concerns a method of using the device.

8 Claims, 1 Drawing Sheet

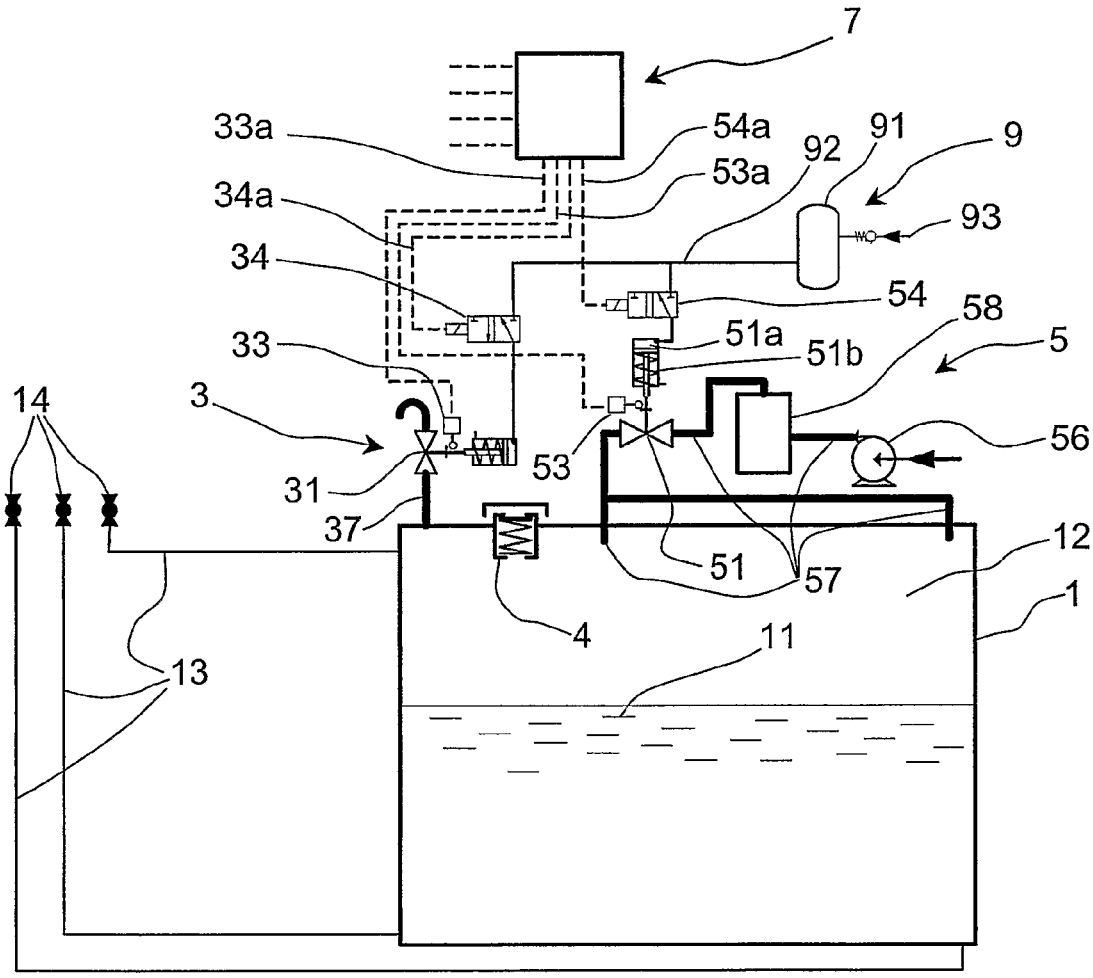
7
33a
54a
92
91
9
53a
34a
93
34
54
58
51a
5
33
51b
14
3
56
53
31
37
12
51
57
1
4
11
13

DEVICE FOR AN INERT GAS INSTALLATION ON A FLOATING VESSEL

The invention concerns a system for automatic shutdown of the supply of inert gas to a cargo tank on a floating vessel, hereinafter also referred to as a ship, in connection with marine casualty. More particularly, it concerns a system comprising a valve arranged to shut down, via manual or automatic operation, the supply of inert gas to the cargo tank when in a situation of marine casualty. Movement of the valve may be achieved even if the ship machinery has stopped, wherein a sensor generates a shutdown signal when in contact with water or being subjected to a predetermined pressure.

A system for eliminating spills of oil and chemicals from cargo and bunker tankers is known from patent application No. 20045545, the content of which is referred to in its entirety. The air inlet of the tank, the inlet of which is normally open to avoid formation of a vacuum in the tank when drawing off of the content thereof, is shut down in a situation of marine casualty, but ambient water may be admitted through a safety valve to balance the pressure between the inside and the outside of the tank at the depth where the wrecked ship is located.

For reasons of safety, among other things, it is desirable for certain types of cargo to maintain a non-explosive environment in the space above the liquid located in the tank, and possibly in the empty tank subsequent to unloading the cargo. This may be achieved by conducting exhaust gases into the tank from the propulsion engine(s) of the ship, or by using particular gases provided for the purpose and stored for use as required.

In a situation of marine casualty, when a ship is sinking and is assuming a position deviating from the normal position, the supply conduits for such gases may become discharge conduits for the ship's ordinary cargo, or water may enter into these or other conduits so as to cause, over time, the cargo to emanate from the very same openings. The supply conduits for inert gas assume large dimensions and, when in open position, may represent a substantial source of leakage. For reasons of safety, it is important to prevent such discharges to the environment. It is therefore of great environmental importance to be able to prevent inert gas conduits from becoming ship cargo discharge conduits from a wrecked ship.

The object of the invention is to remedy or reduce at least one of the disadvantages of the prior art.

The object is achieved by means of features disclosed in the following description and in the subsequent claims.

A first object of the invention is to provide a device arranged to be able to automatically shut down a supply conduit of inert gas into a floating vessel's cargo tank(s) in connection with marine casualty, and when the ship is sinking.

A second object is to provide a method for automatic shutdown of the supply conduit of inert gas into the ship's cargo tank(s) in connection with marine casualty by using the device according to the invention.

In a first aspect, the invention concerns a device for an inert gas installation on a floating vessel, comprising one or several tanks arranged in a manner allowing filling of an explosive liquid and/or a gas therein, wherein an air inlet system is connected to the tank, characterized in that the inert gas installation is provided with a shutoff valve arranged to be able to automatically close a inert gas supply conduit, and wherein the tank is provided with a sensor arranged to respond to a defined, ambient moisture- and pressure level, the sensor also being connected to a valve control system, thereby providing control signals to the valve control system.

Advantageously, the shutoff valve is provided with a pressurized fluid chamber which, upon supply of a pressurized fluid, is arranged to be able to open the shutoff valve, the shutoff valve also being provided with a biased closing device arranged to be able to close the shutoff valve when the pressure in the pressurized fluid chamber is relieved.

Preferably, the shutoff valve is associated with a control valve connected in a signal-communicating manner to the valve control system.

Advantageously, the control valve, when in a first position, is arranged to maintain a connection, in a fluid-communicating manner, between a pressurized fluid system and the shutoff valve, thereby causing the shutoff valve to remain in an open position.

Advantageously, the control valve, when in a second position, is arranged to keep the connection closed between the pressurized fluid system and the shutoff valve, and also to maintain an open connection between the pressurized fluid chamber of the shutoff valve, thereby causing the shutoff valve to assume and maintain a closed position.

Advantageously, the valve control system is arranged to be able to indicate at least the completely open and completely closed positions of the shutoff valve.

Advantageously, the valve control system is arranged to allow manual operation of a control valve of the shutoff valve.

Advantageously, the tank is provided with a safety valve arranged to be able to prevent an underpressure in the tank.

In a second aspect, the invention concerns a method for shutdown of an inert gas installation on a floating vessel, comprising one or several tanks arranged in a manner allowing filling of an explosive liquid and/or a gas therein, wherein an air inlet system is connected to the tank, characterized in that the method comprises the following steps:

- a sensor, which is arranged to respond to a defined, ambient moisture- or pressure level, and which is provided to the tank and is connected to a valve control system, is lowered into water when the vessel is sinking due to marine casualty;
- the sensor generates a predefined control signal which is transmitted to the valve control system;
- the valve control system processes the generated control signal;
- the valve control system causes a control valve, which is associated with a shutoff valve, to close a connection between a pressurized fluid system and the shutoff valve, thereby causing the pressure in a pressurized fluid chamber in the shutoff valve to be relieved, and thereby further causing a biased closing device to move the shutoff valve to a closed position so as to shut down the supply of inert gas to the tank.

An example of a preferred embodiment is described in the following, the embodiment of which is depicted in the accompanying drawing, where:

FIG. 1 schematically shows a cargo tank of a vessel provided with an inert gas installation according to the invention.

In the FIGURE, reference numeral 1 denotes a tank on a vessel (not shown). The tank 1 is provided with an air intake system 3, a safety valve 4, an inert gas installation 5, a valve control system 7, and a pressurized fluid system 9.

The tank 1 is partially filled with a liquid 11, for example an oil product, above which a space 12 is filled with a gas, for example an inert gas provided by the inert gas installation 5. Moreover, the tank 1 is provided with conduits 13 and valves 14 for use in connection with loading and unloading of the liquid 11.

The air intake system 3 comprises a shutoff valve 31, a pipe connection 37 that connects the tank 1 to fresh air, a sensor 33, a control valve 34, a signal-communicating cable 33*a* provided between the sensor 33 and the valve control system 7, a control cable 34*a* provided between the control valve 34 and the valve control system 7, and also a pressurized-fluid-communicating conduit 92 extending from the pressurized fluid system 9, via the control valve 34 and onto the shutoff valve 31. This is described in its entirety in No. 20045545 and hence will not be described in further detail herein.

The purpose of the safety valve 4 is to ensure that a potential underpressure in the tank 1 is balanced when in a situation where the air intake system 3 is shut down, for example in connection with marine casualty, thereby preventing the tank 1 from being deformed due to an external overpressure.

This is described in its entirety in No. 20045545 and hence will not be described in further detail herein.

The inert gas installation 5 comprises a shutoff valve 51 in a supply conduit 57 extending from a pumping device 56 onto the tank 1. A gas accumulator 58 is connected to the supply conduit 57.

The shutoff valve 51 comprises a pressurized fluid chamber 51*a*, which, via a control valve 54, is in fluid-communicating connection with the pressurized fluid system 9. When the pressurized fluid system 9 is pressurized, the shutoff valve 51 is kept open. A biased closing device 51*b* is arranged to be able to close the shutoff valve 51 when the pressure in the pressurized fluid chamber 51*a* is relieved. This is prescribed by the control valve 54 which, when in a first position, provides a connection between the pressurized fluid chamber 51*a* and the pressurized fluid system 9, whereas the valve drains the pressurized fluid chamber 51*a* when the valve is in a second position (shown in the FIGURE). If the pressurized fluid is air, it may be drained to the environment, whereas a liquid may be drained to a reservoir (not shown).

The control valve 54 is connected in a signal-communicating manner to the valve control system 7 via the connection 54*a*. Typically, the control valve 54 may be a magnet valve maintained in its first position by means of an electric current. Upon cessation of the control current, the control valve 54 moves to its second position by means of a biased device, for example a spring (not shown).

A sensor 53, which is arranged to indicate that the environment's moisture- and/or pressure level exceed(s) a predefined limit, is provided at a location suitable for this purpose. In connection with a potential marine casualty, which causes the vessel to sink, the sensor 53 is also provided in a manner allowing it to register that the tank 1 is surrounded by water, possibly water having a certain minimum pressure, implying that the sensor 53 is located at a certain minimum depth. The sensor 53 is connected in a signal-communicating manner to the valve control system 7 via the connection 53*a*.

Typically, the valve control system 7 is a programmable, logic control according to prior art and of known type recognized by the skilled person as suitable for use at the ambient operating conditions. The valve control system 7 is therefore not described in further detail.

Typically, the pressurized fluid system 9 comprises a pressure accumulator 91 and a supply conduit 93 from a pressure-producing source (not shown). By means of the conduit 92, the pressurized fluid is distributed to the shutoff valves 31, 51 via the control valves 34, 54. When using a liquid as a pressurized fluid, for example hydraulic oil, the pressurized fluid system 9 will comprise, in a manner known per se, a reservoir (not shown) for collection of pressurized fluid returning from the shutoff valves 31, 51.

The control valve 54 will be in its first position (not shown) when in a normal operating mode, whereby the pressurized fluid chamber 51*a* of the shutoff valve 51 is pressurized, and the shutoff valve 51 is kept open. The supply of inert gas to the tank 1 may thus take place in accordance with normal criteria.

In a situation of marine casualty, in which the vessel is sinking, and the supply of inert gas to the gas-filled space 12 of the tank 1 is to cease, the following will happen:

The sensor 53 registers an elevated moisture and/or pressure level in its environment. A prescribed signal is transmitted, via the connection 53*a*, to the valve control system 7, which processes this signal and transmits a prescribed control signal to the control valve 54 via the connection 53*a*. Thereby, the control valve 54 will switch over to its second position, and the pressurized fluid chamber 51*a* is drained. Thus, the biased closing device 51*b* will drive the shutoff valve 51 to a closed position, whereby the supply of inert gas ceases.

It is advantageous and obvious to a skilled person for the automatic closing of the shutoff valve 51 to be arranged in a manner allowing the valve control system 7 at least also to be able to switch the control valve 54 to its second position upon discontinuation of the current supply from the vessel's power supply network, whereby the inert gas supply may be stopped also when all other operating systems have broken down due to marine casualty. This is achieved by means of an arrangement of the type described hereinbefore, where the control valve 54 makes sure that the shutoff valve 51 is closed when the control current to the shutoff valve 51 ceases.

The invention claimed is:

1. A device for automatic shutdown of an inert gas installation on a floating vessel in connection with marine casualty, wherein the vessel comprises one or several tanks arranged in a manner allowing filling of an explosive liquid and/or a gas therein, wherein an air inlet system is connected to the tank, and wherein the tank is provided with a sensor arranged to respond to a defined, ambient moisture and pressure level, the sensor also being connected to a valve control system, thereby being able to provide control signals to the valve control system, and wherein the inert gas installation is provided with a shutoff valve arranged to be able to close an inert gas supply conduit, the shutoff valve being connected in a control-signal-communicating manner to the valve control system, characterized in that the tank is provided with a safety valve arranged to be able to prevent an underpressure in the tank.

2. The device according to claim 1, characterized in that the shutoff valve is provided with a pressurized fluid chamber which, upon supply of a pressurized fluid, is arranged to be able to open the shutoff valve, the shutoff valve also being provided with a biased closing device arranged to be able to close the shutoff valve when the pressure in the pressurized fluid chamber is relieved.

3. The device according to claim 1, characterized in that the shutoff valve is associated with a control valve connected in a signal-communicating manner to the valve control system.

4. The device according to claim 2, characterized in that the control valve, when in a first position, is arranged to maintain a connection, in a fluid-communicating manner, between a pressurized fluid system and the shutoff valve, thereby causing the shutoff valve to remain in an open position.

5. The device according to claim 2, characterized in that the control valve, when in a second position, is arranged to keep a connection closed between a pressurized fluid system and the shutoff valve, and also to maintain an open connection between the pressurized fluid chamber of the shutoff valve, thereby causing the shutoff valve to assume and maintain a closed position.

6. The device according to claim 1, characterized in that the valve control system is arranged to be able to indicate at least completely open and completely closed positions of the shutoff valve.

7. The device according to claim 1, characterized in that the valve control system is arranged to allow manual operation of a control valve of the shutoff valve.

8. A method for automatic shutdown of an inert gas installation on a floating vessel in connection with marine casualty, wherein the vessel comprises one or several tanks arranged in a manner allowing filling of an explosive liquid and/or a gas therein, wherein an air inlet system and a safety valve are connected to the tank, and wherein the tank is provided with a sensor arranged to respond to a defined, ambient moisture and pressure level, the sensor also being connected to a valve control system, thereby being able to provide control signals to the valve control system, characterized in that the method comprises the following steps:

the sensor is lowered into water when the vessel is sinking due to marine casualty;

the sensor generates a predefined control signal which is transmitted to the valve control system;

the valve control system processes the generated control signal;

the valve control system causes a control valve, which is associated with a shutoff valve, to close a connection between a pressurized fluid system and the shutoff valve;

pressure in a pressurized fluid chamber in the shutoff valve is relieved;

a biased closing device moves the shutoff valve to a closed position; and a supply of inert gas to the tank is shut down.

* * * * *